US008794424B2

(12) United States Patent
Stauber

(10) Patent No.: US 8,794,424 B2
(45) Date of Patent: Aug. 5, 2014

(54) DEVICE AND METHOD FOR CONVEYING FLAT OBJECTS

(75) Inventor: Hans Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 369 days.

(21) Appl. No.: 13/127,363

(22) PCT Filed: Jul. 2, 2009

(86) PCT No.: PCT/CH2009/000231

§ 371 (c)(1),
(2), (4) Date: Jun. 9, 2011

(87) PCT Pub. No.: WO2010/051650

PCT Pub. Date: May 14, 2010

(65) Prior Publication Data

US 2011/0240441 A1 Oct. 6, 2011

(30) Foreign Application Priority Data

Nov. 4, 2008 (CH) ..... 1724/08
Apr. 6, 2009 (CH) ..... 553/09

(51) Int. Cl.
*B65G 47/86* (2006.01)
*B65G 17/12* (2006.01)

(52) U.S. Cl.
USPC ..... 198/470.1; 198/867.05; 198/867.07; 198/803.7; 198/803.9

(58) Field of Classification Search
USPC ..... 198/867.05, 867.07, 803.7, 803.9, 198/470.1, 476.1
See application file for complete search history.

(56) References Cited

U.S. PATENT DOCUMENTS

| | | | | |
|---|---|---|---|---|
| 1,467,211 | A * | 9/1923 | Wagner et al. | 198/470.1 |
| 2,997,157 | A * | 8/1961 | Siebke | 198/803.7 |
| 3,754,637 | A * | 8/1973 | Carter et al. | 198/470.1 |
| 4,577,855 | A | 3/1986 | Reist | |
| 4,723,770 | A * | 2/1988 | Seidel et al. | 270/52.2 |
| 4,905,818 | A * | 3/1990 | Houseman | 198/803.7 |
| 6,182,960 | B1 * | 2/2001 | Keller et al. | 198/470.1 |
| 6,196,538 | B1 * | 3/2001 | Stauber et al. | 198/470.1 |
| 6,511,065 | B1 * | 1/2003 | Cote et al. | 271/270 |
| 6,554,268 | B1 * | 4/2003 | Keller et al. | 271/11 |
| 6,666,447 | B2 * | 12/2003 | Keller | 271/11 |

FOREIGN PATENT DOCUMENTS

EP 1717179 11/2006

* cited by examiner

*Primary Examiner* — Leslie A Nicholson, III
(74) *Attorney, Agent, or Firm* — Rankin, Hill & Clark LLP

(57) ABSTRACT

An apparatus for conveying and discharging flat, preferably flexible articles, in particular printed products, the apparatus including a plurality of grippers which can be moved in a conveying direction (F) along a continuous conveying path (U) defined by a conveying mechanism. The grippers include a first gripper jaw and a second gripper jaw, which can assume a clamping position and an open position relative to one another. The first gripper jaw is longer than the second gripper jaw and includes a first gripper part, which in the clamping position interacts with the second gripper jaw, and a second gripper part, which in the clamping position projects beyond the second gripper jaw. The orientation of the first and second gripper parts of the first gripper jaw relative to one another is variable and can be adjusted by a control means.

18 Claims, 6 Drawing Sheets

DEVICE AND METHOD FOR CONVEYING FLAT OBJECTS

BACKGROUND OF THE INVENTION

1. Field of the Invention

The invention lies in the field of conveying technology and relates to a device and to a method for conveying and releasing flat, preferably flexible objects, in particular printed products, based on a gripper conveyor. The further development according to the invention in particular serves for the controlled release of the objects.

2. Description of Related Art

In printing technology, in particular with the production of newspapers, increasingly more complex objects are conveyed and/or processed in other manners with larger and larger speeds. Such objects are for example printed products, such as newspapers, magazines, brochures, books or also credit cards, CDs, goods samples and likewise. These are selected individually and are collated into collections.

The high speeds and the complexity of the products demand very exact control of the position of the individual constituents at every point in time of the processing, in particular with the transfer of products between two installation parts of a complete installation. With the transfer of objects from a gripper conveyor to a further station, e.g. a conveyor belt, the grippers for example are merely opened, and the objects come to lie on the conveyor belt due to gravity. Thereby, it may occur that the individual products which were commonly held by the gripper, dislocate or rotate with respect to one another. This may lead to defects with the further processing.

It is, therefore, the object of the invention to further develop a gripper conveyor in a manner such that a well controlled release of the held objects is possible, in particular a deposition on a conveyor surface.

BRIEF SUMMARY OF THE INVENTION

The device for conveying and releasing flat and preferably also flexible objects, in particular printed products, comprises a plurality of grippers which are movable in a conveying direction along a closed conveying path which is defined by a conveyor member, e.g. a chain with several chain members. The grippers comprise a first and a second gripper jaw which may assume a clamping position and an open position relative to one another. According to the invention, the first gripper jaw is extended with respect to the second gripper jaw. It comprises a first gripper part which in the clamping position cooperates with the second gripper jaw, and a second gripper part which in the clamping position projects beyond the second gripper jaw. The orientation of the first and second gripper parts relative to one another is variable and may be set with a control device.

In the operating method, the closed grippers, with objects received therein, are moved to a transfer region and the grippers are opened there. The second gripper parts are controlled in a manner such that they press the objects in the transfer region against a conveyor rest of a conveying-away device, in particular already shortly before the opening, and until the object lies completely on the conveyor rest The device makes do without additional co-moved guide elements for stabilising and positioning the objects to be released, by way of the controllable second gripper parts.

The objects to be released may, for example, be guided in a controlled manner, for example with the transfer to a further component of the complete installation, by way of the orientation of the first and second gripper parts being changeable relative to one another in a controlled manner. Hereby, they cooperate with external counter-elements for example. Thereby, pressure may also be exerted on the object by way of the actively controlled, movable second gripper part. Displacements of the held objects are thus avoided with and after the opening of the grippers.

The grippers according to the invention may, for example, be realised on the basis of conventional grippers with essentially equally long gripper jaws. One of these "conventional" gripper jaws according to the invention is provided at its distal end with a movable continuation which projects beyond the other gripper jaw. The respective gripper jaw with the continuation in the context of the invention is indicated as a whole as "first gripper jaw". That part of this first gripper jaw which together with the second gripper jaw carries out the conventional clamping function, is indicated as "first gripper part". The continuation is indicated as "second gripper part". The connection, in particular, is realised by way of a joint.

Preferably, a conveying-away device with a plane or essentially plane and compliant conveyor rest is present, in particular a belt conveyor. This device is arranged relative to the gripper conveyor such that objects released by the grippers are deposited onto the conveyor rest supported by gravity, i.e. from the top. The region, in which the conveying path of the gripper conveyor approaches the conveying-away device to such an extent, that the transfer may take place, is indicated as the transfer region. The gripper conveyor in the transfer region has an opening device for the grippers. The objects are pressed against the conveyor rest in a preferably surfaced manner by way of second gripper parts, before, during and after the opening of the grippers. The control device thus preferably sets a minimum distance between the second gripper parts and the conveying path of the grippers, which is not fallen short of with the transfer.

Preferably, the object is held between the second gripper part and the conveying-away device in a clamping manner, during and after the opening of the grippers, until the complete release to the conveying-away device. The speeds of the gripper and of the conveying-away device are adapted to one another for this.

The objects on release to the conveying-away device may be accompanied over an extended stretch and thereby be fixed, by way of the orientation of the second gripper part being varied in a controlled manner. Its orientation for this is set, for example, such that it is adapted (e.g. running parallel) to the counter-element, e.g. to the conveyor rest of the conveying-away device, in order to achieve a surfaced clamping effect.

Alternatively or additionally, the second gripper part may be flexible for achieving a surfaced effect, so that it may roll on the object or on the counter-element. In this case, the second gripper parts in the transfer region at least in the vicinity of the connection to the first gripper part, preferably have an orientation which is roughly parallel to the conveying path. The conveying path is preferably curved in the transfer region. The second gripper part in a view transverse to the conveying direction is thus orientated tangentially to a circular path which has the same centre as the conveying path, but a larger radius.

Controllable second gripper parts may be realised in a mechanically simple manner. Since the gripper jaws in the normal case are distanced from their conveyor member, a change of the path curvature of the conveying path leads to the distances of two reference points on adjacent grippers also changing. Such a distance change, for example, also occurs between a reference point on a gripper and the conveyor member, e.g. a subsequent chain member. Therefore, the orientation of the second gripper part may be controlled by way of a suitable mechanical coupling between the second gripper part and a subsequent gripper or the conveying member. For this, the second gripper part is coupled, for example, mechanically to the mentioned elements, e.g. via a lever. A separate control cam independent of the actual grippers or their conveyor member is also possible, but is mechanically more complicated.

The first gripper part and the second gripper jaw in each case have an elasticity or stiffness which in a clamping position permits an adequate clamping effect. A certain flexibility or spring effect may exist for compensating differently thick products. One may also compensate thickness variations within the gripped objects by way of the second gripper jaw comprising several separately resilient fingers which together cooperate with a first gripper jaw.

In a preferred embodiment of the invention, the second gripper part is designed in a comparatively shape-stable or stiff manner, thus without (as in the subsequent embodiment) an elasticity of the second gripper part being given an essential function. The second gripper part is curved according to the path course of the conveying path in the transfer region, so that if the second gripper part is located in the transfer region, the curvature of the second gripper part runs concentrically to the conveying path in the transfer region, thus with a different radius, but with the same centre. If here and hereinafter one speaks of the curvature of the second gripper part, then with this, one means the curvature at an outer surface of the second gripper part, i.e. the surface on which the products bear. The second gripper part may roll on the object to be released or on the conveyor surface on account of its shape, during or after the second gripper part transfers an object onto a for example plane or approximately plane, compliant conveyor surface of the conveying-away device. The second gripper part may therefore cooperate with the objects in a surfaced and not only pointwise manner or along a line.

In another embodiment of the invention, the second gripper part has an elasticity which is larger than that of the first gripper part. The second gripper part on account of its deformability may roll on the object to be released or on the conveyor surface, during or after the second gripper part transfers an object to a, for example plane, conveyor surface of the conveying-away device. The second gripper part may therefore cooperate with the object in a surfaced manner and not only in a pointwise manner or along a line. The elasticity is preferably not so large that the second gripper part no longer acts as a rest surface or support surface. The elasticity is therefore selected such that the second gripper part does not essentially deform by way of the weight force of the gripped collection of products. These elastic second gripper parts may thus be realised with as well as without the mechanical control of their orientation.

An even better controllable product release is achieved by way of at least one flexible continuation which projects from the second gripper part and reaches into the region of the first gripper part, being connected to the second gripper part. The upper sides of the continuation and of the second gripper part are preferably flush with one another. In the extended condition of both gripper parts (upper sides aligned to one another), the continuation lies on the upper side of the first gripper part, wherein the respective upper sides are aligned to one another. In the angularly bent condition of the two gripper parts (upper sides orientated at an angle to one another), the continuation projects from the first gripper part. On opening the gripper therefore, the object is pressed away from the first gripper part by the continuation, for example towards a conveying-away device. Product dislocation on release is additionally avoided by way of this.

Apart from the support function with the product release, the extended first gripper jaw may assume an additional function. At least in the open position of the gripper, it preferably forms a rest surface for the objects. For this, preferably at least its second gripper part is so wide in a direction transverse to the conveying direction, that objects may be deposited thereon in a stable manner. The second gripper part may e.g. be wider than the second gripper jaw. The gripper may also be applied for collating objects by way of this: different printed products, e.g. intermediate products or supplements may be supplied to the opened gripper and may be laid onto one another whilst forming a stack. The gripper, thus, on collation additionally assumes the function of a pocket conveyor. The orientation of the second gripper part is thereby preferably set such that the support function is fulfilled, thus the second gripper part does not yield under loading. Preferably, the first and second gripper part is aligned to one another in the region of the conveying path, in which the collation is carried out.

For example, a plurality of feed devices are present for feeding the objects into the grippers, and the exits of these feed devices lie behind one another in a collation region of the conveying path, in a row essentially parallel to the conveying path.

An aligning unit may also be present, which laterally aligns the objects arranged in the open grippers. For this, it is advantageous, but not absolutely necessary for the second gripper parts to be less wide transverse to the conveying direction than a typical object width.

The invention is advantageously applicable in all cases, with which a well controllable transfer of objects from a gripper conveyor to a station such as e.g. a conveying-away station, in particular to a belt conveyor, is desired.

Preferably, the function of the release, thus the opening of the grippers for letting go of the held collection of products may be switched, so that selected collections are not released, but remain in the gripper and are led back. With this, a correcting function may be realised by way of defect collections being ejected or missing products being supplemented by a device for collation ("repaired") with a renewed passage.

BRIEF DESCRIPTION OF THE DRAWINGS

Examples of the invention are represented in the drawings and are described hereinafter. There are shown in a purely schematic manner in.

DETAILED DESCRIPTION OF THE INVENTION

Figure 1:
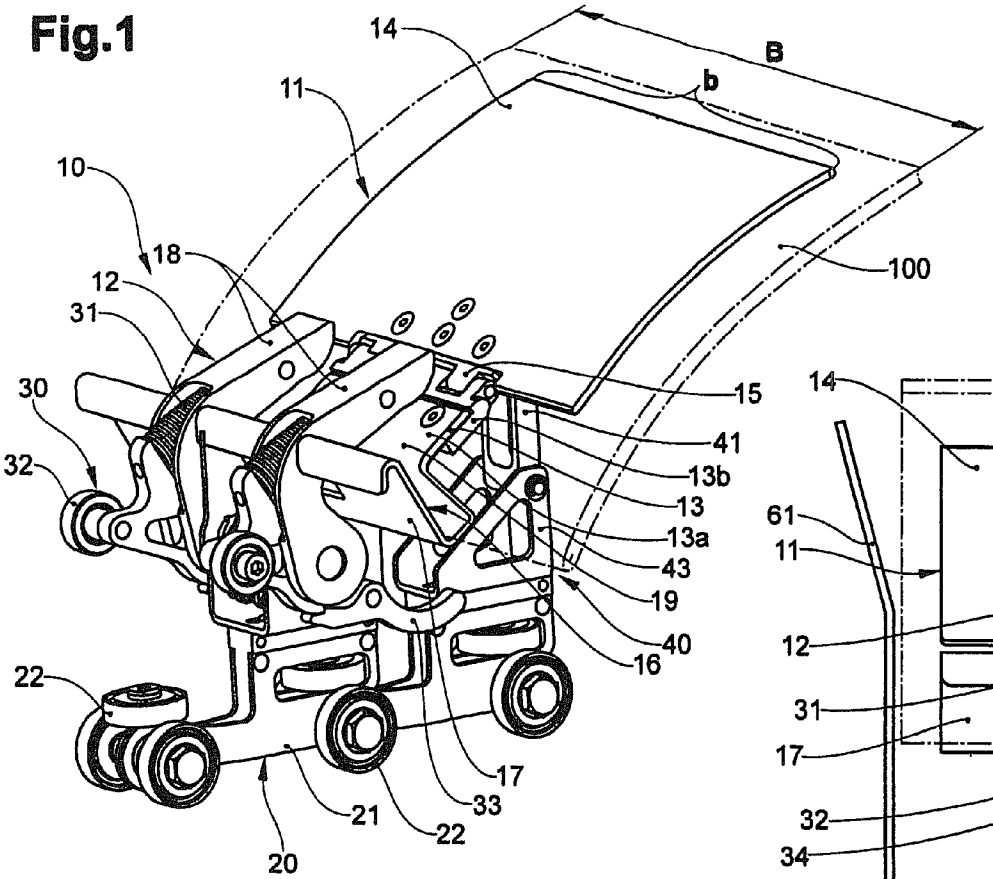
FIG. 1 a perspective view of a gripper of a device according to the invention.

FIG. 1 shows a perspective view of a gripper 10 of a device 1 according to the invention. Details of the device are shown in the FIGS. 3*a*, 3*b*, 4 and 5. The device 1 comprises several grippers 10 which are attached on a conveying member 20 in the form of a chain with several chain members 21. In this example, each second chain member 21 carries a gripper 10. Also each chain member 21 may be provided with a gripper 10. The shape of the conveying path U is set by a channel 23. The chain rolls in the channel 23 by way of guide elements 22 in the form of rollers and this chain moves the grippers 10 in the conveying direction F which corresponds to the channel direction. The conveying path U for example has linear regions (FIGS. 4+5) or curved regions with a certain radius of curvature R (FIG. 3*a*+*b*) or with a variable curvature.

The grippers 10 comprise two gripper jaws 11, 12 which in each case form a functional unit, but may consist of several elements. The shorter second gripper jaw, here for example, comprises two separate fingers 18 which are arranged next to one another transversely to the conveying direction. A pivot mechanism 30 is present, with which the gripper jaws 11, 12 may be adjusted relative to one another. The pivot mechanism 30 comprises control elements in the form of cam rollers 32 and a locking 33. The cam rollers 32, together with a control cam 34 (FIG. 2), serve for transferring the gripper 10 into the clamping position. In the clamping position, the gripper 10 is locked by the lever 33. Product unevenness is compensated by way of both fingers 18 being resilient independently of one another by way of spring 31. The gripper 10 is opened by way of an opening element 35 (FIGS. 2, 3*a*+*b*) acting on the locking 33 and pressing this away. The opening element 35 may be switchable, i.e. with selected collections, the opening element 35 is displaced such that the respective lever 33 is not actuated and the gripper 10 is not opened, and the collection of products (or an individual product) which is held in the gripper 10, is not released. Thus the collection may be conveyed back and ejected or supplemented.

The longer first gripper jaw 11 is constructed as follows: it comprises a shape part 19, e.g. a bent sheet metal piece, which is L-shaped in a lateral view (see FIGS. 3*a* and 3*b*) A first surface of this shape part 19 serves as a first gripper part 13, i.e. may cooperate with the second gripper jaw 12 in a clamping manner. A second surface of this shape part 19, which projects therefrom roughly at right angles, serves as a base surface 17 of the gripper 10 and forms an abutment 16 for the products to be accommodated. A second gripper part 14 is connected at the distal end 13*a* of the first gripper part 13 to this gripper part via a joint 15. For this, the distal end 13*a* of the first gripper part 13 has a reinforcement 13*b*, for example. The second gripper part 14 is a two-dimensional, flexible element, and/or is designed according to the course of the revolving path U with regard to its shape. In the second case, the second gripper part is curved such that its curvature centre in the transfer region coincides with the centre M of the curvature of the revolving path U. A width b of the second gripper part 14 is smaller than a typical product width B. The second gripper part 14 on its rear side (not visible in FIG. 1) is connected to a control mechanism 40 for setting its orientation. The control mechanism 40 has a rigid lever 41 with the length L. The lever 41 is articulately connected to the reinforcement element 42 part on the second gripper part 14 and to a bearing element 43. The respective pivot axes are indicated at A1 and A2 respectively. The first pivot axis A1 has a distance d>0 to the joint 15. The distance d is about a third to a quarter of the total length of the second gripper part 14. The bearing element 43 here is attached on the adjacent chain member 21 which trails in the conveying direction F. The bearing element 43 could also be designed or fastened on a subsequent gripper 10, i.e. the lever 41 could be attached directly on the subsequent gripper 10. If the second gripper part 14 is sufficiently stable, one may also make do without the reinforcement element 42.

Figure 2:
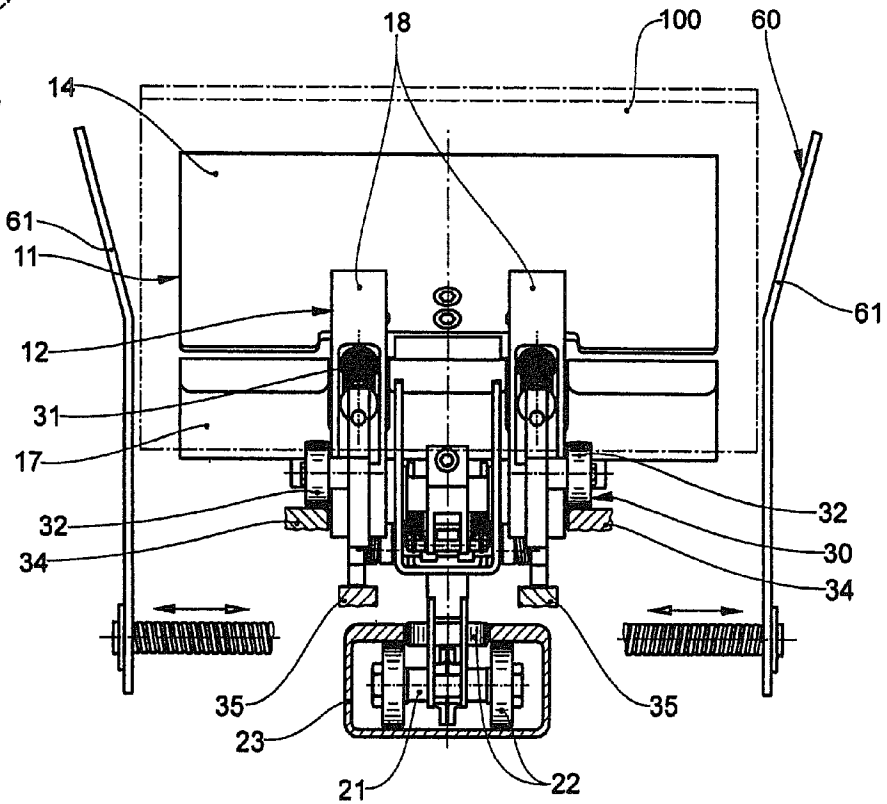
FIG. 2 the gripper of FIG. 1 in a view in the conveying direction.

An aligning unit 60 is arranged in part regions of the conveying path U and may act on the objects in the grippers 10. As is shown in FIG. 2, the aligning unit 60 for example comprises aligning elements 61 arranged laterally of the conveying path U, whose distance may be adjusted.

Figure 3A:
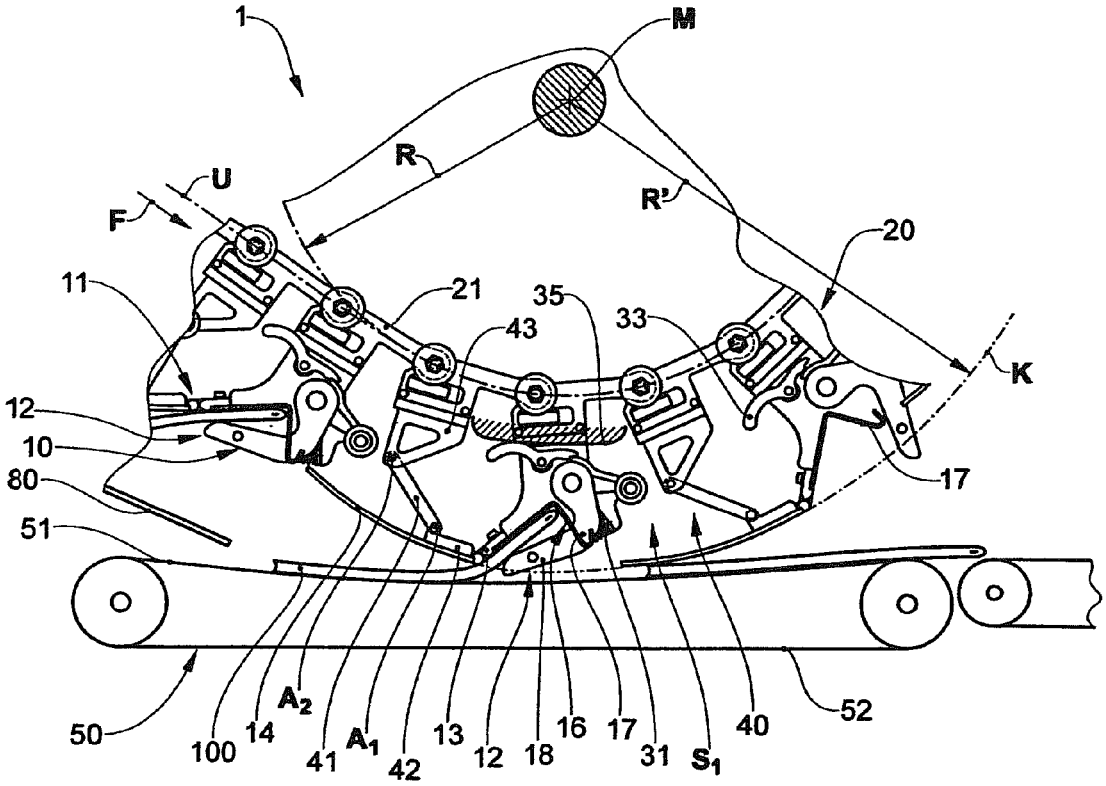
FIGS. 3*a* and 3*b* the transfer region of a device according to the invention, at different points in time with the release of objects.
Figure 3B:
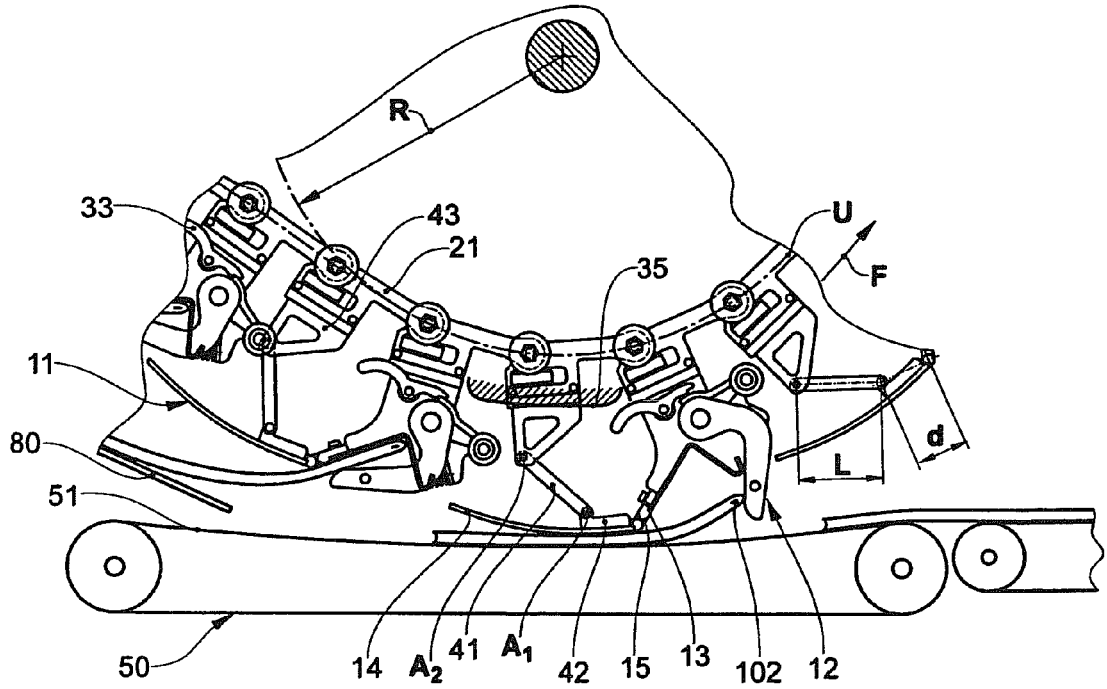

A conveying-away device 50 is, for example, present in a further part region of the conveying path U. The region, in which the device cooperates with the conveying away device 50, is also indicated as a transfer region. An example of such a conveying-away device 50 is shown in FIGS. 3*a* and 3*b*, it is here a belt conveyor with a conveyor belt 52 which forms an essentially plane conveyor rest 51 for products to be taken over. The optionally switchable opening element 35 acts on the locking 33 at an opening location S1, in order to open the grippers 10, so that the transfer may take place.

Figure 4:
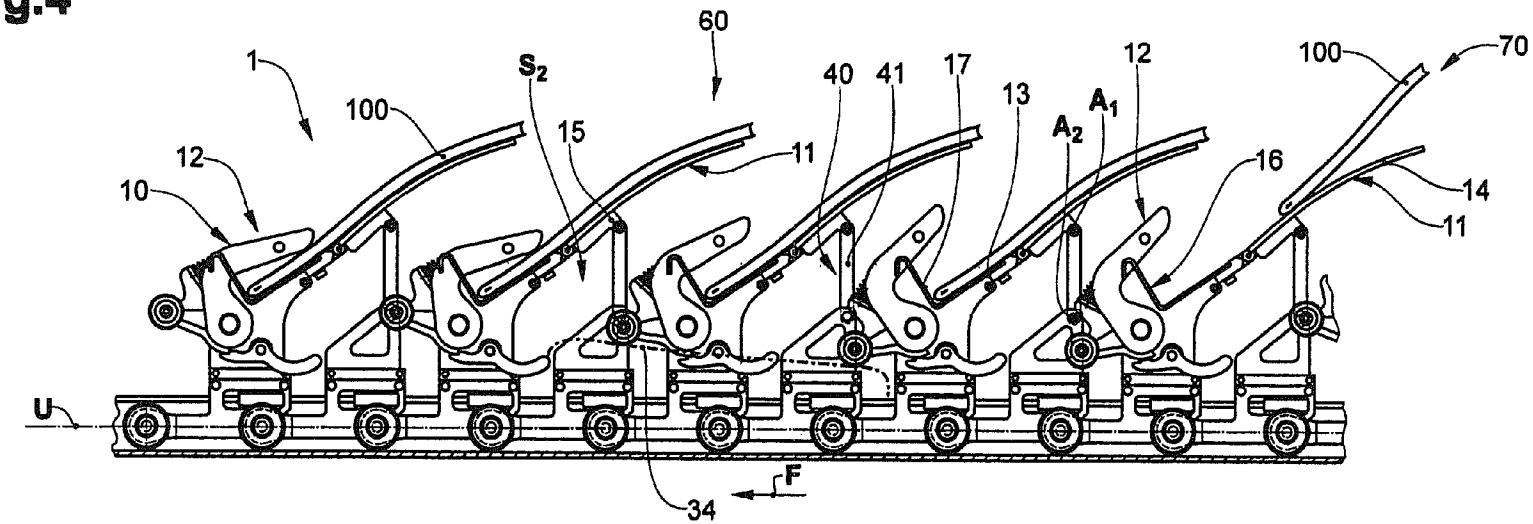
FIG. 4 another part region of the conveying path, in which objects are introduced into the opened grippers.

FIG. 4 finally shows an example for the receiving of the products 100 into the grippers 10. The products 100 are introduced into the open grippers by a feed unit 70. Also further feed units (not drawn) may be present for introducing further products. The grippers are closed at a closure location S2 by way of a suitable cam.

The function of the device 1 and the grippers 10 is described hereinafter, particularly with regard to the controlled transfer of products to the conveying-away device 50:

The length L of the lever 41 and the distance d (see FIG. 3*b*) of its pivot axis A1 to the joint 15 are selected such that the second gripper part 14 in a view transverse to the conveying direction F is roughly aligned to the first gripper part 13 when the conveying path U is straight. This situation is shown in FIGS. 4+5. The lever 51 here is orientated perpendicularly to the conveying direction F. The gripper parts 13, 14 are inclined by roughly 20-60° opposite to the conveying direction F. In this position therefore, a largely plane rest surface is formed by the first gripper jaw 11. The objects 100 may now be introduced along this rest surface into the opened grippers 10 (FIG. 4). The objects 100 abut on the abutment 16 and are laterally aligned, as the case may be, by the aligning unit 60 (FIG. 2). When required, further feed units 70 may be present, which lay further objects onto the already received objects 100. Thereby, the objects 100 are supported from below in a surfaced manner by way of the first gripper jaw 11.

Figure 5:
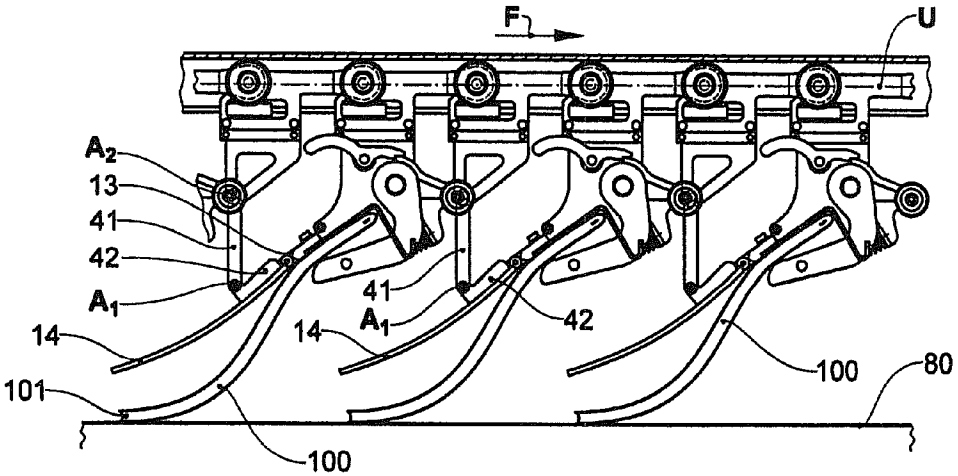
FIG. 5 another part region of the conveying path, in which objects are conveyed by the closed grippers in a hanging manner.

After the lateral aligning, the grippers 100 are closed at the closure location S2. The objects are held in a clamping manner between the second gripper jaw 12 and the first gripper part 13 of the first gripper jaw 11. In the clamped condition, they are conveyed over an infinite stretch along the conveying path U. As shown in FIG. 5, the conveying upside down is also possible. The trailing free edges 101 of the objects 100 preferably hang freely or slide on a stationary support surface 80 or are supported by way of a co-running conveying means, for example a belt.

The objects are released in a curved part of the conveying path U. With the transition from the linear into the curved part, the distance between the second pivot axis A2 and any point on the first gripper part 13 (e.g. to the joint 15) increases. Since the length L of the lever 41 is constant, the second gripper part 14 is pivoted relative to the first gripper part 13 and is pulled towards the conveying member 20. This is shown in the left region of the drawing in FIG. 3*a*. The length of the lever 41 and the position of the axes A1, A2 are selected such that the second gripper part 14 at least in the region of the joint 15 (or the reinforcement element 42) is aligned roughly concentrically (with a shape-stable and curved second gripper part 14) or tangentially (with a flexible second gripper part 14) to the conveying path U. If the conveying path in the transfer region is described roughly by a circular segment with a radius R and centre M, the second gripper part 14 thus runs roughly tangentially to or on a circular segment K with a larger radius R'>R and with the same centre M. With a shape-stable and curved second gripper part 14, its curvature, thus, corresponds to the inverse of this larger radius K'. The conveyor surface 51 of the conveying-away device 50 likewise runs tangentially to this circular segment K. The speed of the conveying surface 51 is preferably at least approximately equal to the speed of the objects 100 and thus also approximately equal to the speed of the gripper on the circular segment K.

The second gripper parts 14 press an object 100 therefore in a surfaced manner against the conveying surface 51, whilst this object is released from the gripper 10. Since the second gripper parts 14 are shaped concentrically to the path course or are flexible, they roll together with the object 100 on the conveyor surface 51 and accompany the objects 100 on transfer, until its leading edge 102 has left the gripper 10.

Alternatively, the orientation of the second gripper parts 14 may also be controlled such that the second gripper parts 14 at least in a part region of the transfer region run roughly parallel to the conveying surface 51 and also accompany the objects 100 in this manner.

The gripper 10 is opened if or after the clamping or stabilising effect has been created between the gripper part 14 and the conveying surface 51. This is represented in FIG. 3*b*. Thus one succeeds in a well controlled transfer, with which the objects are guided until their leading edges 102 have left the grippers 10.

Figures 6, 7:
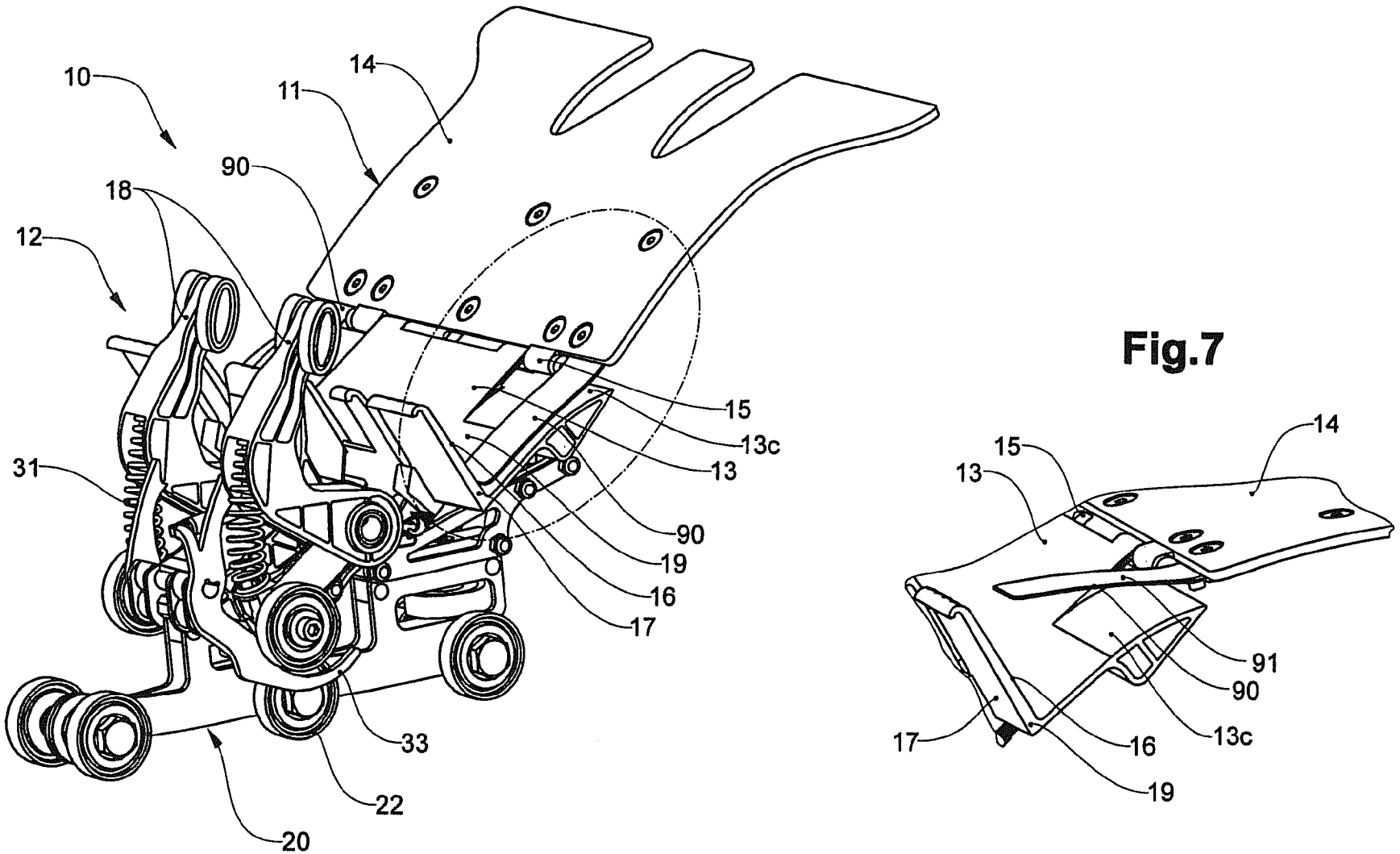
FIG. 6 a perspective view of a further gripper of a device according to the invention.
FIG. 7 a detail of the joint region of the gripper of FIG. 6.

FIG. 6 shows a further gripper 10 which is basically constructed as the gripper of FIG. 1. Parts which correspond to one another are provided with the same reference numerals. The differences are dealt with hereinafter.

The main difference lies in a flexible continuation 90 which is connected to the pivotable second gripper part 14 of the extended first gripper jaw 11. The continuation 90 is a thin element which is rectangular in a plan view and which is flexible by way of a suitable selection of the shape or of the material. The continuation 90 consists, for example, of spring steel.

In each case, a continuation 90 is located on the outer lateral edge of that edge of the second gripper part 14 which faces the joint 15. The continuation 90 points towards the gripper jaw or to the abutment 16 and is aligned with the second gripper part 14. The continuation 90 lies on the first gripper part 13 in the condition, in which the first and second gripper part 13, 14 form a continuous, essentially plane support surface with one another and are aligned with one another (FIG. 6). The second gripper part 13 has a region 13*c* with a reduced thickness, in which its upper side is slightly curved, so that the upper side 91 of the continuation 90 does not project out of the support surface.

FIG. 7 shows the condition, in which the first and second gripper part 13, 14 are pivoted relative to one another out of the straight position (FIG. 6). The continuation 90 is now lifted from the first gripper part 13.

Figure 8:
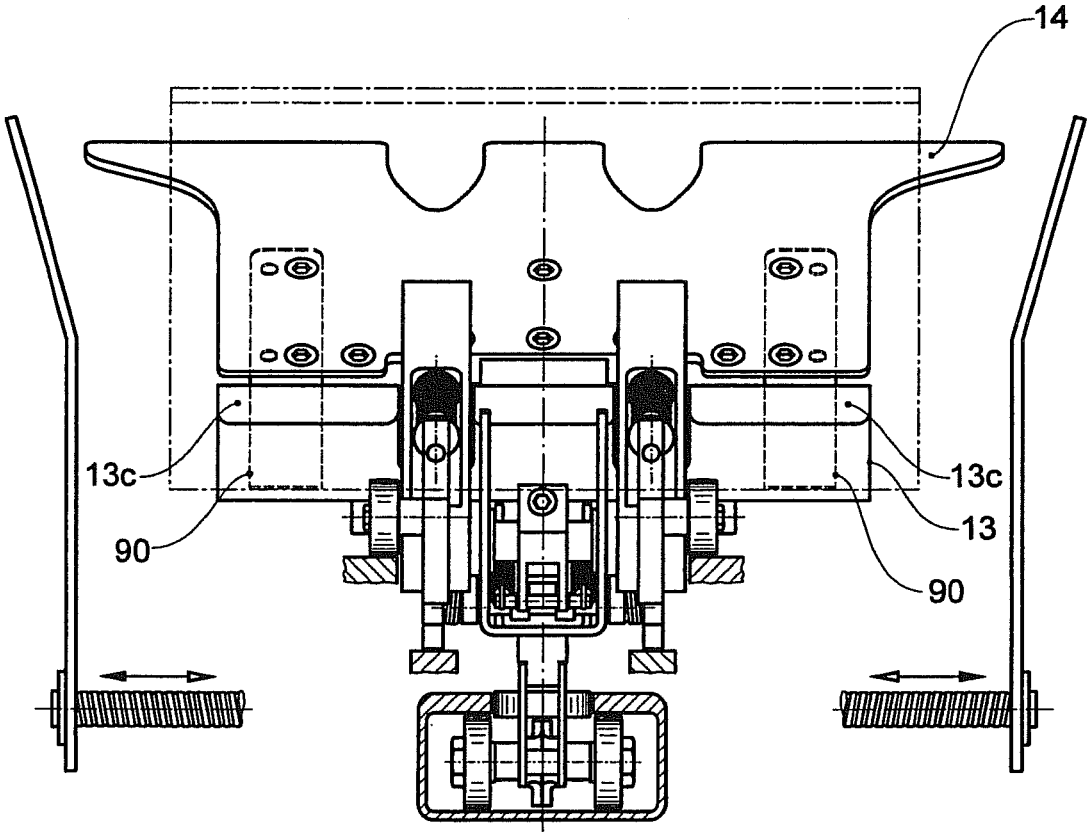
FIG. 8 the gripper of FIG. 6 in a view in the conveying direction.

As may be particularly recognised from FIG. 8, the second gripper part 13 in contrast to FIG. 1 is not rectangular, but is designed in a laterally projecting manner towards the outer end.

Figure 9A:
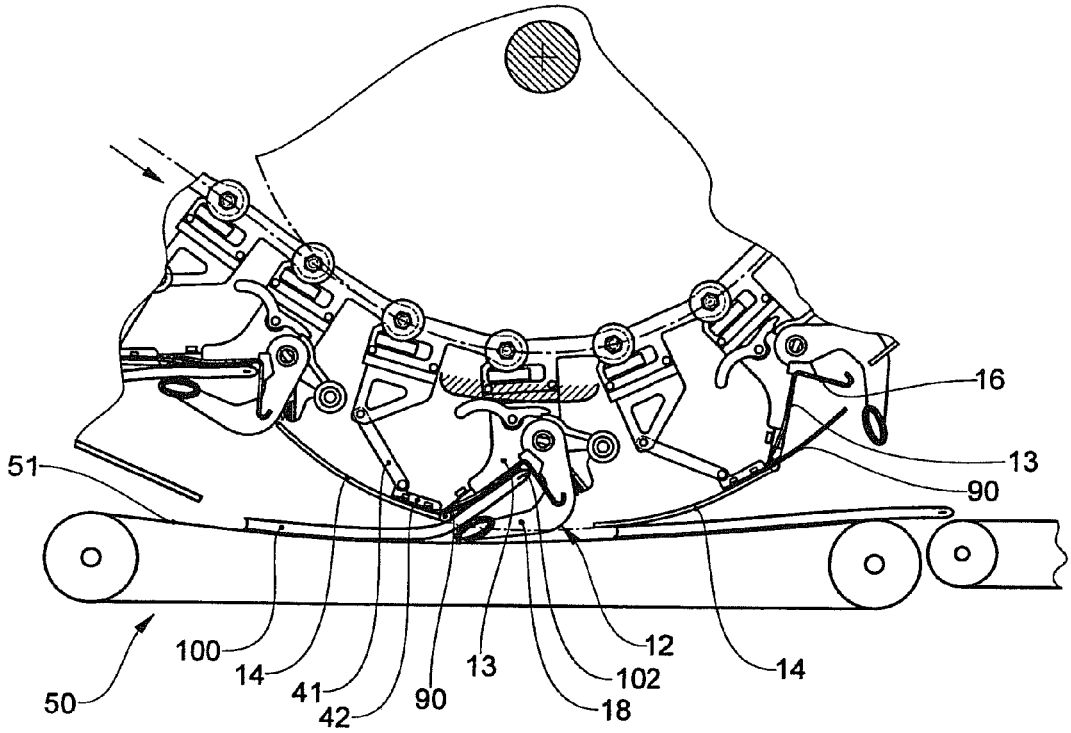
FIGS. 9*a* and 9*b* the transfer region of a device according to the invention, with a gripper according to FIG. 6 at different points in time with the release of objects.
Figure 9B:
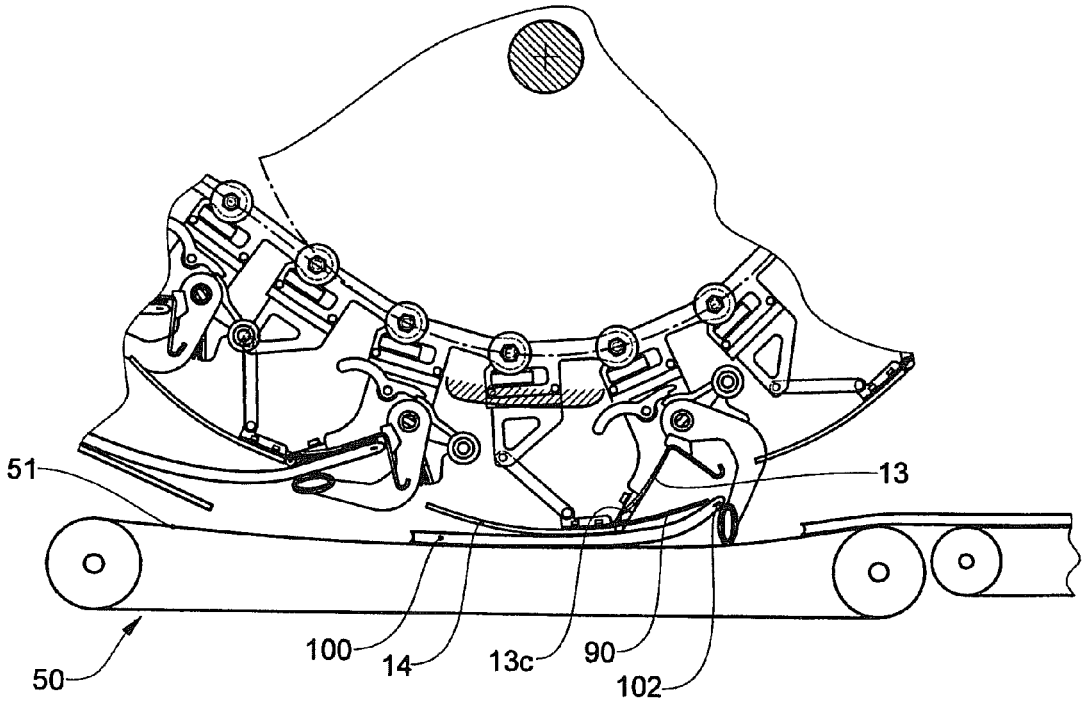

The function of the continuations 90 is explained by way of FIGS. 9*a*+*b*. The objects 100 are deformed on transfer to the conveying-away device 50, since their leading edge 102 is still held between the first gripper part 13 and the second gripper jaw 12 and is bent upwards, whilst the trailing part of the object 100 already lies on the horizontal conveying surface 51 and is pressed by the second gripper part 14 against the conveyor surface 51. On opening the gripper 100, the lifted front edge 102 provides an engagement surface for the head wind. It may therefore occur that the object 100 is not cleanly deposited, but dislocates on deposition. This is undesirable.

Continuations 90 counteract the lifting from the conveyor surface 51, by way of them also pressing the leading part of the object onto the conveyor surface 51 after opening the gripper 100. By way of this, the gap between the object 100 and the conveyor surface 51 is directly closed after opening the gripper 10. In the closed condition of the gripper 10, the continuation 90 on account of its flexibility is bent as the gripped object 100. In the open condition, it assumes its rest position represented in FIGS. 6 and 7.

The invention claimed is:

1. A device for conveying and releasing flat objects, in particular printed products, the device comprising:

a plurality of grippers which are movable in a conveying direction along a closed conveying path defined by a conveyor member;

wherein the grippers comprise a first and a second gripper jaw which relative to one another may assume a clamping position and an open position;

a conveying-away device with a conveyor rest, wherein the conveying away device in a transfer region of the conveying path cooperates with the grippers such that objects that are released from the grippers are deposited onto the conveyor rest, wherein the first gripper jaw is extended with respect to the second gripper jaw and comprises a first gripper part which in the clamping position cooperates with the second gripper jaw, and a second gripper part which in the clamping position projects beyond the second gripper jaw;

wherein the orientation of the first and second gripper parts of the first gripper jaw relative to one another is variable and may be set with a control device such that the objects to be released are guided in a controlled manner with the transfer to the conveyor rest; and wherein the second gripper parts are movable, controlled in a manner such that the objects in the transfer region are pressed by the second gripper parts against the conveyor rest, before, during and after the opening of the grippers.

2. A device according to claim 1, wherein the conveying-away device is a belt conveyor.

3. A device according to claim 1, wherein the conveying path is arcuate in the transfer region and the orientation of the second gripper parts in the transfer region is controlled in a manner such that the second gripper parts are aligned essentially concentrically to the conveying path and/or in a manner adapted to the conveyor rest.

4. A device according to claim 1, wherein the first gripper part is shape-stable and that the second gripper part is connected to the first gripper part by way of a flexible connection.

5. A device according to claim 4, wherein the flexible connection comprises a joint.

6. A device according to claim 1, wherein the second gripper part is shape-stable and arcuate.

7. A device according to claim 6, wherein a radius of curvature of an outer surface of the second gripper part is selected such that, when the second gripper part is located in a transfer region of the conveying path, the outer surface of the second gripper part runs essentially concentrically to the conveying path.

8. A device according to claim 1, wherein the second gripper part is flexible.

9. A device according to claim 8, wherein the second gripper part consists of an elastic material or has shape elasticity.

10. A device according to claim 1, wherein the device comprises the control device which cooperates with the second gripper part, in order to sets its orientation relative to the first gripper part.

11. A device according to claim 10, wherein the control device comprises a lever which is pivotably mounted on the second gripper part about a first pivot axis as well as on a bearing element about a second pivot axis, in a manner such that the orientation of the lever relative to the conveying path changes in dependence on the curvature of the conveying path, wherein the bearing element is formed by a subsequent gripper or is arranged thereon or is arranged on the conveyor member between two grippers.

12. A device according to claim 1, wherein the first gripper jaw, at least in the open position, forms a rest surface for the objects.

13. A device according to claim 1, further comprising an aligning unit for aligning the objects in the opened grippers transversely to the conveying direction.

14. A device according to claim 1, further comprising a switchable opening element which acts on a locking element of the grippers and selectively activates or does not activate the opening of a gripper in a transfer region of the conveying path.

15. A device according to claim 1, further comprising at least one flexible continuation which is connected to the second gripper part and projects from this, wherein the flexible continuation, depending on the relative position of the two gripper parts, bears on a rest surface of the first gripper part or is lifted therefrom.

16. A method for conveying and releasing flat objects, in particular printed products, comprising the following steps:

moving a plurality of grippers in a conveying direction along a closed conveying path defined by a conveyor member, wherein the grippers comprise a first and a second gripper jaw which relative to one another may assume a clamping position and an open position;

wherein the first gripper jaw is extended with respect to the second gripper jaw and comprises a first gripper part which in the clamping position cooperates with the second gripper jaw, and a second gripper part which in the clamping position projects beyond the second gripper jaw;

moving the closed grippers, with objects received therein, to a transfer region and opening the grippers in the transfer region;

depositing the objects which are released from the opened grippers onto the conveyor rest of a conveying-away device in the transfer region;

setting the orientation of the first and second gripper parts of the first gripper jaw relative to one another by means of a control device; and controlling movement of the second gripper parts in a manner such that the second gripper parts press the objects in the transfer region against the conveyor rest of the conveying-away device such that the released objects are guided in a controlled manner during their transfer to the conveyor rest; and wherein the second gripper parts are movable, controlled in a manner such that the objects in the transfer region are pressed by the second gripper parts against the conveyor rest, before, during and after the opening of the grippers.

17. A method according to claim 16, wherein the orientation of the second gripper parts, on transfer of the objects, is set essentially concentrically to the conveying path and/or in a manner adapted to the conveying rest.

18. A method according to claim 16, wherein the objects in the opened grippers are aligned transversely to the conveying direction and the grippers are subsequently closed.

* * * * *